US006109891A

United States Patent [19]

Sato

[11] Patent Number: 6,109,891

[45] Date of Patent: Aug. 29, 2000

[54] ELECTRICALLY DRIVEN PUMP DEVICE WITH THREE DIMENSIONAL PASSAGE

[75] Inventor: Toshihiro Sato, Toyohashi, Japan

[73] Assignee: Asmo Co., Ltd., Kosai, Japan

[21] Appl. No.: 09/247,654

[22] Filed: Feb. 9, 1999

[30] Foreign Application Priority Data

Jun. 4, 1998 [JP] Japan ..... 10-156197

[51] Int. Cl.[7] ..... F04B 17/00; F04B 35/04

[52] U.S. Cl. ..... 417/423.14; 417/423.1

[58] Field of Search ..... 417/423.14, 423.1

[56] References Cited

U.S. PATENT DOCUMENTS

| | | | |
|---|---|---|---|
| 3,759,290 | 9/1973 | D'Alba | 137/565 |
| 5,184,946 | 2/1993 | Sato | 417/423.9 |
| 5,480,289 | 1/1996 | Lee | 417/360 |
| 6,017,191 | 1/2000 | Harmsen | 416/247 R |
| 6,037,688 | 3/2000 | Gilliland et al. | 310/89 |

FOREIGN PATENT DOCUMENTS

U-2-49657 of 1990 Japan .

*Primary Examiner*—Teresa Walberg
*Assistant Examiner*—Vinod D Patel
*Attorney, Agent, or Firm*—Fish & Richardson P.C.

[57] ABSTRACT

A washer pump device has a cylindrical central housing, a motor, a top housing and a bottom housing for accommodating a motor and an impeller. The central housing comprises an outer wall and an inner wall arranged coaxially. A groove is formed in the bottom surface of the outer wall and is closed by a flange of the bottom housing to provide a horizontally extending arcuate passage. One end of the passage is open to the outside of the housing through an air vent which extends in a vertical direction. The other end of the passage is open to the inside of the housing through an air vent which extends in a vertical direction. The passage and two air vents form a three dimensional passage so that water droplets are restricted from entering into a motor housing chamber.

20 Claims, 3 Drawing Sheets

ELECTRICALLY DRIVEN PUMP DEVICE WITH THREE DIMENSIONAL PASSAGE

CROSS REFERENCE TO RELATED APPLICATION

This application relates to and incorporates herein by reference Japanese patent Application No. 10-156197 filed on Jun. 4, 1998.

BACKGROUND OF THE INVENTION

1. Field of the Invention

The present invention relates to an electrically driven pump device and, more particularly, to an electrically driven pump device having an improved air passage structure.

2. Related Art

A conventional washer device for vehicles has, as shown in FIG. 6, a washer pump device 40, which jets washer fluid of a washer tank from a washer nozzle. The washer pump device 40 is driven electrically by a direct current (d.c.) motor 42 accommodated within a motor housing 41. Specifically, an impeller 45 is accommodated within a pump housing 44 and is coupled with a rotary shaft 43 of the motor 42 to rotate with the rotary shaft 43. An airpassage 46 is provided between the motor housing 41 and the pump housing 44 to maintain the pressure uniformly between the inside and outside of the motor housing 44, thereby ensuring normal operation of the washer pump device 40. The air passage 46 is formed in a labyrinth shape (L-shape) to restrict rain and water splash from entering into the motor housing 41.

However, water is still likely to enter into the inside of the motor 42, because water rebounds on air passage walls and moves upward when the water hits the air passage 46 at high speeds from the bottom side. This will occur more often in a vehicle which has the washer pump device 40 at the front side of a vehicle front tire, because the tire generates water splash when the vehicle runs over puddles.

SUMMARY OF THE INVENTION

It is therefore an object of the present invention to provide an electrically driven pump device which restricts water splash from entering into a motor.

According to the present invention, an air passage is provided in a housing having a motor accommodating chamber to communicate the inside and outside of the housing. The air passage is formed in a three dimensional shape. Preferably, the air passage comprises a series of a vertically extending passage open to the outside of the housing, a horizontally extending passage and a vertically extending passage open to the inside of the housing.

BRIEF DESCRIPTION OF THE DRAWINGS

Other objects, features and advantages of the present invention will become more apparent from the following detailed description made with reference to the accompanying drawings.

DETAILED DESCRIPTION OF THE PREFERRED EMBODIMENT

Figure 1:
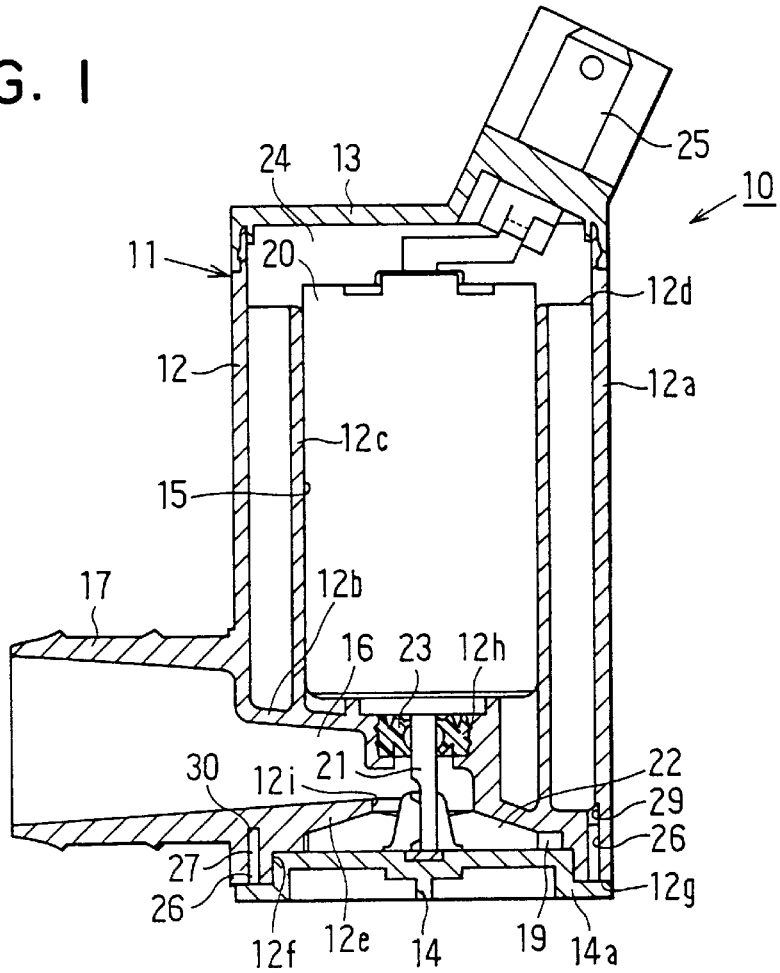
FIG. 1 is a sectional view of a washer pump device according to an embodiment of the present invention.
Figure 2:
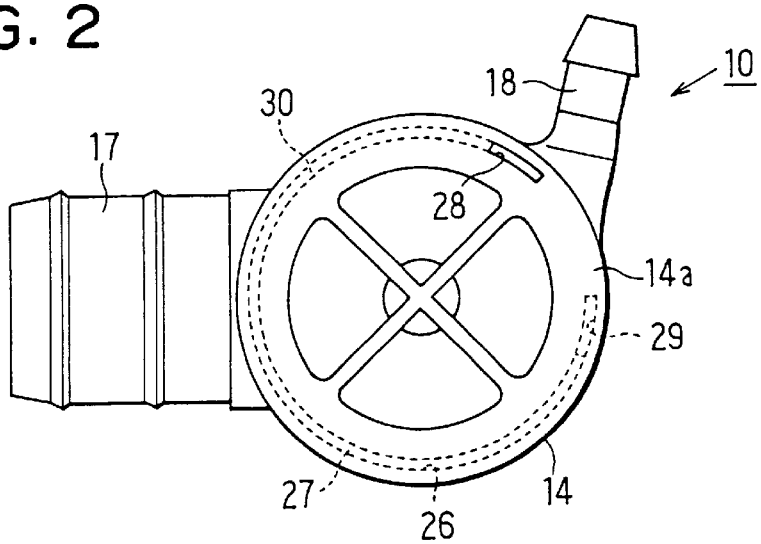
FIG. 2 is a bottom view of the washer pump device shown in FIG. 1.

Referring first to FIGS. 1 and 2 showing a vehicle washer pump device 10 as an embodiment of the present invention, a housing 11 of the washer pump device 10 comprises a central housing 12, a cap-shaped top housing 13 which closes the top opening of the central housing 12, and a cap-shaped bottom housing 14 which closes the bottom opening of the central housing 12. The washer pump device 10 is mounted on a vehicle so that the housing 11 is held upright, that is the central axis of the housing 12 extends in a vertical direction.

The housing 12 is formed into a cylindrical shape having an outer wall 12*a* and an inner wall 12*c*, which are concentric to each other. An upper partition wall 12*b* is formed integrally with the walls 12*a*, 12*c* at the radially inner side of the outer wall 12*a* to partition the top opening and the bottom opening.

The inner wall 12*c* is also integral with the upper partition wall 12*b*. The inner wall 12*c* has a top end which is lower than that of the outer wall 12*a*. The upper partition wall 12*b* and the inner wall 12*c* define a motor accommodating chamber 15, which accommodates a direct current motor 20 tightly therein. The outer wall 12*a* and the inner wall 12*c* are separated in a radial direction to have a spacing therebetween. The spacing is held uniform by space holders 12*d* arranged at a regular interval.

A lower partition wall 12*e* is provided below the upper partition wall 12*b*. The lower partition wall 12*e* is integral with the upper partition wall 12*b*. The partition walls 12*b*, 12*e* define a fluid inlet chamber 16. A fluid inlet pipe 17 is formed integrally with the outer wall 12*a* to introduce washer fluid from a washer tank (not shown) into the inlet chamber 16 through a hose (not shown) in a direction perpendicular to the housing 11, that is, in the horizontal direction. As shown in FIG. 2, a fluid outlet pipe 18 is formed integrally with the outer wall 12*a* at a position lower than the lower partition wall 12*e*. The fluid outlet pipe 18 extends perpendicularly to the housing 11 and communicates with the bottom opening. The fluid outlet pipe 18 is connected to washer nozzles (not shown) through a hose (not shown).

The bottom opening is closed by the bottom housing 14 to provide a pump chamber 19 between the bottom housing 14 and the lower partition wall 12*e*. More specifically, the bottom inner periphery of the outer wall 12*a* is extended outward in the radial direction to provide a fitting part 12*f*, so that the fitting part 12*f* is tightly fitted therein. The bottom housing 14 has a flange 14*a*, which extends outward in the radial direction and abuts the bottom end surface 12*g* of the outer wall 12*a* to maintain a fluid tightness of the pump chamber 19. Thus, the fluid outlet pipe 18 is communicated with the pump chamber 19.

The motor 20 encased within the motor chamber 15 has a rotary shaft 21, which extends in the axial direction of the housing 11 into the pump chamber 19 through a through hole 12*h* formed in the upper partition wall 12*b* and an inlet opening 12*i* formed in the lower partition wall 12*e*. An impeller 22 is fixed to the rotary shaft 21 in the pump chamber 19. When the impeller 22 rotates with rotation of the motor 20, the washer fluid in the washer tank is introduced into the pump chamber 19 through the fluid inlet pipe 17, inlet chamber 16 and inlet opening 12*i*. The washer fluid in the pump chamber 19 is pumped by the impeller 22 and discharged to the washer nozzles through the fluid outlet pipe 18. A seal 23 is disposed in the through hole 12*h*, so that the washer fluid in the inlet opening 16 is restricted from entering into the motor accommodating chamber 15.

The top opening is closed by the top housing 13, so that the top housing 13 defines a motor housing chamber 24 together with the outer wall 12*a* and the inner wall 12*c*. An electrical connector 25 is formed integrally with the top housing 13, so that electric power is supplied to the motor 20 through the connector 25.

Figure 3:
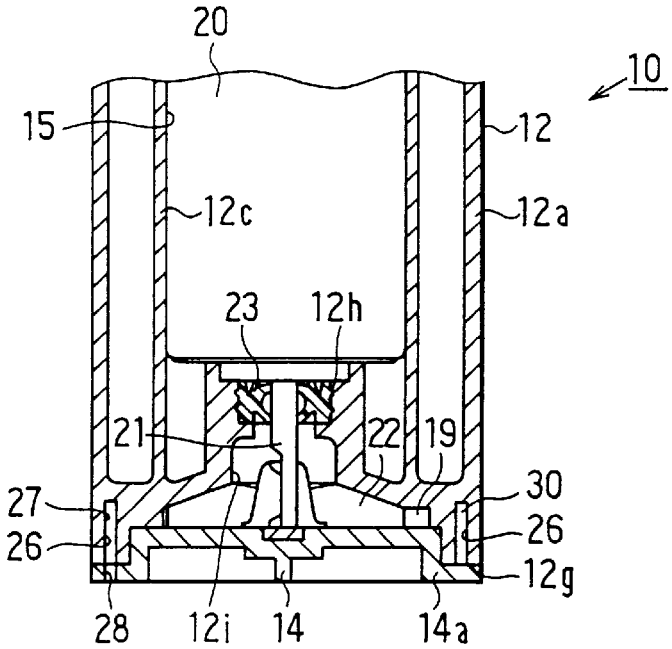
FIG. 3 is another sectional view of the washer pump device shown in FIG. 1.

The washer pump device 10 further has an air passage 30 for maintaining the same pressure in the housing chamber 24 and in the outside of the housing 11. Specifically, a groove 26 is formed on the bottom edge surface 12*g* in the circumferential direction except for the position where the fluid outlet pipe 18 is formed. Thus, the groove 26 provides an arcuately extending passage 27 which is closed by the flange 14*a* of the bottom housing 14. An air vent 29 is formed in the outer wall 12*a* as an inner vent in the axial direction at the position where one end of the passage 27 exists. The air vent 29 communicates the motor housing chamber 24 and the passage 27. Further, as shown in FIG. 3, an air vent 28 is formed in the flange 14*a* as an outer vent in the axial direction at the position where the other end of the passage 27 exists. The air vent 28 communicates the groove 27 and the outside of the housing 11.

Thus, the housing chamber 24 and the outside of the housing 11 are communicated with each other through the air passage 30 formed by the air vent 28, passage 27 and air vent 29. As a result, the air passage 30 extends in the axial (vertical) direction, in the circumferential (horizontal) direction and again in the axial direction, thus forming a three dimensional passage, that is, a labyrinthine passage.

The above embodiment provides the following advantages.

(1) As the air passage 30 is in the three dimensional or labyrinth shape, water droplets produced by water splash entering into the air vent 28 will not reach the inside of the housing 11 (motor housing chamber 24) while rebounding in the arcuate passage 27 and the air vent 29. Thus, the motor 20 is protected from water.

(2) Further, as the motor 20 is disposed within the inner wall 12*c*, the water droplets, even entering into the spacing between the walls 12*a* and 12*c* through the air vent 29, will rarely leap high enough to reach the motor accommodating chamber 15. Further, the motor 20 is protected more from water.

(3) Still further, as the arcuate air passage 27 is formed by closing the groove 26 by the flange 14*a* of the bottom housing 14, the air passage is formed with ease and in low cost.

The above embodiment may be modified as follows.

Figure 4:
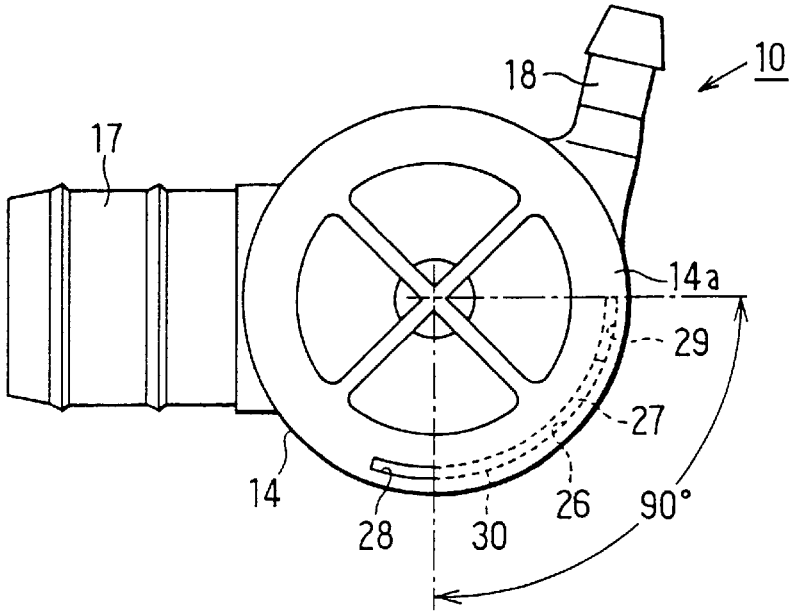
FIG. 4 is a bottom view of a washer pump device according to a modification of the embodiment.

(1) The groove 26 formed on the bottom edge surface 12*g* of the outer wall 12*a* may extend about 90 degrees in the circumferential direction as shown in FIG. 4. Alternatively, it may extend less degrees as long as it causes water droplets to curve three dimensionally.

Figure 5:
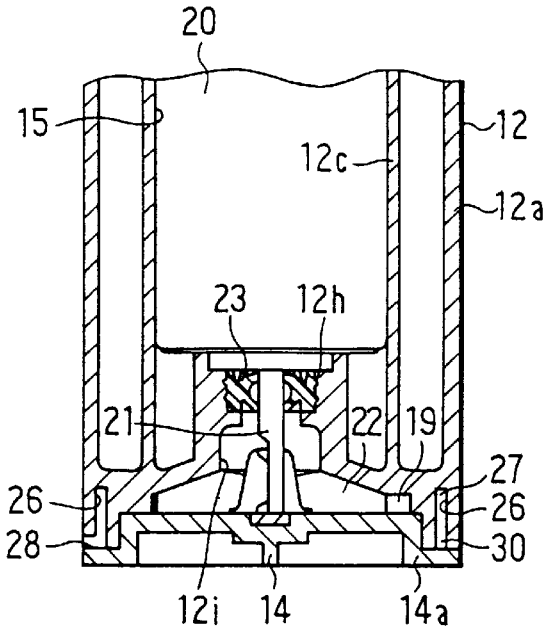
FIG. 5 is a sectional view of the washer pump device shown in FIG. 4.
Figure 6:
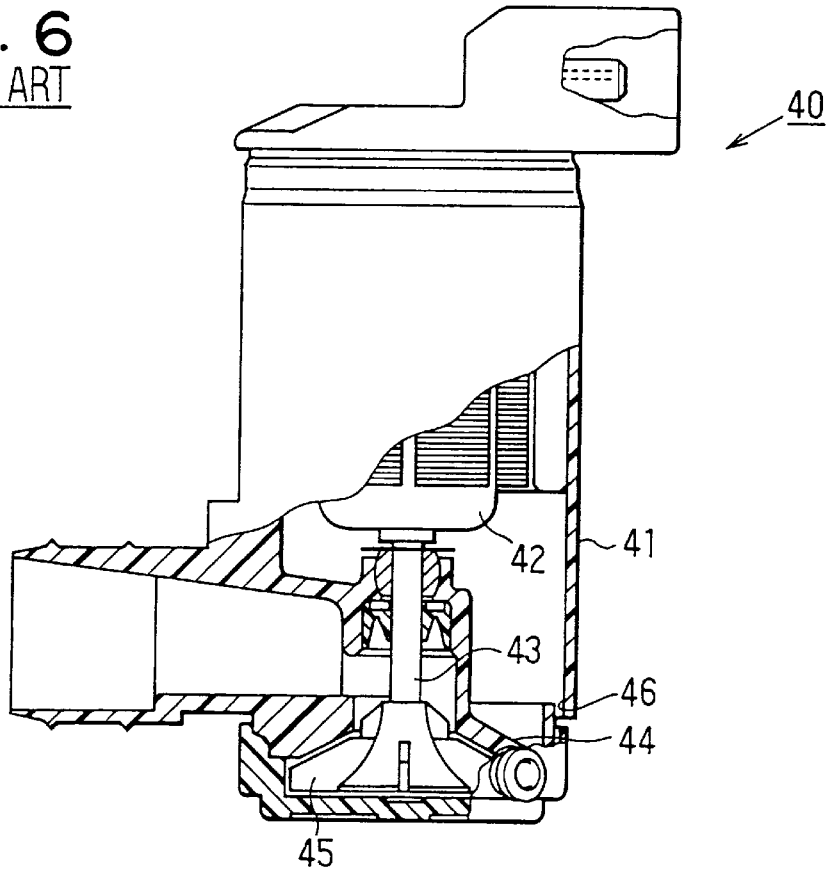
FIG. 6 PRIOR ART
FIG. 6 is a sectional view of a conventional washer pump device.

(2) The air vent 28 as the outer vent of the air passage 30 may be formed in the outer wall 12*a* near the bottom edge surface 12*g* as shown in FIG. 5, so that it extends in the radial (horizontal) direction. This arrangement will simplify work of fitting the bottom housing 14 into the central housing 12.

(3) The groove 26 may be formed into a shape other than the arcuate shape as long as it extends along the bottom circumferential periphery of the housing 12.

(4) Further, the housing 11 need not have the inner wall 12*c*, so that the space defined by the outer wall 12*a* and the top partition wall 12*b* may be used as the motor accommodating chamber 15.

The present invention should not be restricted to the disclosed embodiments and modifications, but may be implemented in many other ways without departing from the spirit of the invention. For instance, the present invention may be applied to various electrically driven pumps other than the washer pump.

What is claimed is:

1. An electrically driven pump device comprising:

a pump;

a motor for driving the pump; and a housing having a central body defining a motor accommodation chamber in which the motor is accommodated, wherein the central body has an air passage which extends in three dimensional directions to communicate an inside and an outside of the housing.

2. The pump device of claim 1, wherein the air passage includes:

a groove formed in an axial end surface of a wall of the central body to extend in a direction perpendicular to an axial direction of the central body, the groove providing a groove passage with an end body which closes one end opening of the cylindrical body;

an outer vent formed in the end body at a position where one end of the groove passage exists, the outer vent extending in the axial direction of the cylindrical body and communicating the outside of the housing and the groove passage; and an inner vent formed in the wall at a position where another end of the groove passage exists, the inner vent extending in the axial direction of the cylindrical body and communicating the inside of the housing and the groove passage.

3. The pump device of claim 2, wherein:

the groove is formed to extend arcuately along a circular circumference of the central body.

4. The pump device of claim 3, wherein the housing has:

a partition wall formed at a radially inside of the wall to separate the one end opening from another end opening of the cylindrical body; and another wall formed into a cylindrical shape coaxially with the wall and extending from the partition wall to accommodate therein the motor.

5. The pump device of claim 4, wherein:

the pump has an impeller which pumps washer fluid of a vehicle.

6. The pump device of claim 3, wherein:

a partition wall formed at a radially inside of the wall to separate the one end opening from another end opening of the cylindrical body; and another wall formed into a cylindrical shape coaxially with the wall and extending from the partition wall to accommodate therein the motor.

7. The pump device of claim 1, wherein the air passage includes:

a groove formed in an axial end surface of a wall of the central body to extend in a direction perpendicular to an axial direction of the central body, the groove providing a groove passage with an end body which closes an end opening of the cylindrical body;

an outer vent formed in the end body at a position where one end of the groove passage exists, the outer vent extending in the direction perpendicular to the axial direction of the cylindrical body and communicating the outside of the housing and the groove passage; and an inner vent formed in the wall at a position where another end of the groove passage exists, the inner vent extending in the axial direction of the cylindrical body and communicating the inside of the housing and the groove passage.

8. The pump device of claim 7, wherein:

the groove is formed to extend arcuately along a circular circumference of the central body.

9. The pump device of claim 8, wherein the housing has:

a partition wall formed at a radially inside of the wall to separate the one end opening from another end opening of the cylindrical body; and another wall formed into a cylindrical shape coaxially with the wall and extending from the partition wall to accommodate therein the motor.

10. The pump device of claim 9, wherein:

the pump has an impeller which pumps washer fluid of a vehicle.

11. The pump device of claim 8, wherein:

a partition wall formed at a radially inside of the wall to separate the one end opening from another end opening of the cylindrical body; and another wall formed into a cylindrical shape coaxially with the wall and extending from the partition wall to accommodate therein the motor.

12. An electrically driven pump device comprising:

a pump;

a motor for driving the pump; and a housing having a central body defining a motor accommodation chamber in which the motor is accommodated, wherein the central body has an air passage which extends arcuately along a coaxial path around the motor to communicate an inside and an outside of the housing.

13. The pump device of claim 12, wherein the air passage includes:

a groove formed in an axial end surface of a wall of the central body to extend arcuately and in a direction perpendicular to an axial direction of the central body, the groove providing a groove passage with an end body which closes one end opening of the cylindrical body;

an outer vent formed in the end body at a position where one end of the groove passage exists, the outer vent extending in the axial direction of the cylindrical body and communicating the outside of the housing and the groove passage; and an inner vent formed in the wall at a position where another end of the groove passage exists, the inner vent extending in the axial direction of the cylindrical body and communicating the inside of the housing and the groove passage.

14. The pump device of claim 13, wherein the housing has:

a partition wall formed at a radially inside of the wall to separate the one end opening from another end opening of the cylindrical body; and another wall formed into a cylindrical shape coaxially with the wall and extending from the partition wall to accommodate therein the motor.

15. The pump device of claim 14, wherein:

the pump has an impeller which pumps washer fluid of a vehicle.

16. The pump device of claim 12, wherein the air passage includes:

a groove formed in an axial end surface of a wall of the central body to extend arcuately and in a direction perpendicular to an axial direction of the central body, the groove providing a groove passage with an end body which closes an end opening of the cylindrical body;

an outer vent formed in the end body at a position where one end of the groove passage exists, the outer bent extending in the direction perpendicular to the axial direction of the cylindrical body and communicating the outside of the housing and the groove passage; and an inner vent formed in the wall at a position where another end of the groove passage exists, the inner vent extending in the axial direction of the cylindrical body and communicating the inside of the housing and the groove passage.

17. The pump device of claim 16, wherein the housing has:

a partition wall formed at a radially inside of the wall to separate the one end opening from another end opening of the cylindrical body; and another wall formed into a cylindrical shape coaxially with the wall and extending from the partition wall to accommodate therein the motor.

18. The pump device of claim 17, wherein:

the pump has an impeller which pumps washer fluid of a vehicle.

19. The pump device of claim 12, wherein:

the central body includes an outer wall and an inner wall arranged coaxially and extending in the axial direction, and a partition wall extending perpendicularly to the outer wall and the inner wall at a position between the motor and the impeller to separate the motor and the impeller from each other; and the air passage includes an outer vent extending in the axial direction to open to the outside of the housing, an arcuate groove extending from the outer vent arcuately around the impeller, and an inner vent extending in the axial direction to open to a space between the outer wall and the inner wall of the housing.

20. The pump device of claim 19, wherein:

the inner wall of the housing defines the motor accommodation chamber therein; and the motor accommodation chamber and the space between the outer wall and the inner wall are communicated only at an axial end of the inner wall which is opposite to the partition wall in the axial direction of the housing.

* * * * *